US008616520B2

(12) United States Patent
Baader

(10) Patent No.: US 8,616,520 B2
(45) Date of Patent: Dec. 31, 2013

(54) FULL WALL HEIGHT CONCRETE FORM STRAPPING AND INTERCONNECT SYSTEM

(75) Inventor: Benjamin G. Baader, Onoway (CA)

(73) Assignee: Green Built Manufacturing Inc., Edmonton (CA)

( * ) Notice: Subject to any disclaimer, the term of this patent is extended or adjusted under 35 U.S.C. 154(b) by 1029 days.

(21) Appl. No.: 12/200,846

(22) Filed: Aug. 28, 2008

(65) Prior Publication Data

US 2009/0057530 A1 Mar. 5, 2009

(30) Foreign Application Priority Data

Aug. 28, 2007 (CA) ..... 2597832

(51) Int. Cl.
*E04G 11/06* (2006.01)
*E04G 17/065* (2006.01)

(52) U.S. Cl.
USPC ..... 249/40; 249/216; 52/426

(58) Field of Classification Search
USPC ..... 249/40, 43, 44, 47, 190, 194, 213, 216; 52/223.2, 223.3, 426, 442
See application file for complete search history.

(56) References Cited

U.S. PATENT DOCUMENTS

| | | | | | |
|---|---|---|---|---|---|
| 775,685 | A | * | 11/1904 | Shute et al. | 249/44 |
| 929,470 | A | * | 7/1909 | Neil | 249/20 |
| 958,419 | A | * | 5/1910 | Mowat | 249/19 |
| 1,482,434 | A | * | 2/1924 | Hotchkiss | 249/192 |
| 1,588,229 | A | * | 6/1926 | Hotchkiss | 249/45 |
| 1,743,136 | A | * | 1/1930 | Harrold | 249/192 |
| 2,781,657 | A | * | 2/1957 | Taylor | 52/223.7 |
| 2,898,659 | A | * | 8/1959 | Shoemaker | 249/191 |
| 3,103,046 | A | * | 9/1963 | Micheal | 249/197 |
| 3,211,413 | A | * | 10/1965 | Low, III | 249/41 |
| 3,236,490 | A | * | 2/1966 | Lovgren et al. | 249/45 |
| 3,767,158 | A | * | 10/1973 | Mikus | 249/192 |
| 3,788,020 | A | * | 1/1974 | Gregori | 52/309.12 |
| 4,516,372 | A | | 5/1985 | Grutsch | |
| 4,669,234 | A | * | 6/1987 | Wilnau | 52/98 |
| 4,706,429 | A | | 11/1987 | Young | |
| 4,750,308 | A | | 6/1988 | McKay | |
| 4,967,528 | A | * | 11/1990 | Doran | 52/309.12 |
| 4,972,646 | A | | 11/1990 | Miller et al. | |
| 5,072,569 | A | | 12/1991 | VanTassel | |
| 5,074,088 | A | * | 12/1991 | Bergeron et al. | 52/309.12 |
| 5,169,585 | A | * | 12/1992 | Le Gourrierec | 264/219 |
| 5,459,971 | A | * | 10/1995 | Sparkman | 52/426 |
| 5,465,542 | A | | 11/1995 | Terry | |

(Continued)

FOREIGN PATENT DOCUMENTS

| | | | |
|---|---|---|---|
| CA | 2264099 | A1 | 2/1998 |
| CA | 2298435 | A1 | 9/1998 |
| WO | 96/15335 | A1 | 5/1996 |

*Primary Examiner* — Joshua Rodden
(74) *Attorney, Agent, or Firm* — Christensen O'Connor Johnson Kindness PLLC

(57) ABSTRACT

A building element includes a first and second panel each having an outer surface and an inner surface. There is more than one spacer positioned adjacent to the inner surface of the first panel and the inner surface of the second panel to form a cavity for receiving a structural component. Each end of each spacer has a first part of a two-part connector. A connector strap extends longitudinally along each of the outer surfaces of the first and second panels. The connector straps carry more than one second part of the two-part connectors that connects to the first part of the two part connector such that the connector strap attaches to the spacer.

23 Claims, 6 Drawing Sheets

(56) References Cited

U.S. PATENT DOCUMENTS

| | | | | | |
|---|---|---|---|---|---|
| 5,497,592 | A | | 3/1996 | Boeshart | |
| 5,699,640 | A | | 12/1997 | Bourgeois et al. | |
| 5,729,942 | A | | 3/1998 | Moore, Jr. | |
| 5,761,874 | A | | 6/1998 | Hayakawa | |
| 5,809,725 | A | | 9/1998 | Cretti | |
| 5,861,105 | A | | 1/1999 | Martineau | |
| 5,896,714 | A | | 4/1999 | Cymbala et al. | |
| 5,992,114 | A | * | 11/1999 | Zelinsky et al. | 52/426 |
| 6,119,432 | A | | 9/2000 | Niemann | |
| 6,178,711 | B1 | * | 1/2001 | Laird et al. | 52/427 |
| 6,240,693 | B1 | | 6/2001 | Komasara et al. | |
| 6,389,758 | B1 | * | 5/2002 | Martin, Jr. | 52/125.2 |
| 6,401,413 | B1 | | 6/2002 | Niemann | |
| 6,571,523 | B2 | | 6/2003 | Chambers | |
| 6,665,992 | B2 | * | 12/2003 | Hew | 52/562 |
| 6,832,456 | B1 | | 12/2004 | Bilowol | |
| 6,945,506 | B2 | | 9/2005 | Long, Sr. | |
| 2004/0079860 | A1 | * | 4/2004 | Ward et al. | 249/33 |
| 2005/0028467 | A1 | | 2/2005 | Bentley | |
| 2005/0108985 | A1 | | 5/2005 | Bravinski | |
| 2006/0010831 | A1 | | 1/2006 | Skakie | |

* cited by examiner

FULL WALL HEIGHT CONCRETE FORM STRAPPING AND INTERCONNECT SYSTEM

FIELD

The present application relates to a full wall height concrete form strapping and interconnect system for use in concrete forming.

BACKGROUND

Canadian Patent No. 2,298,435 (Cymbala et al.) entitled "Insulating concrete form system" discloses a concrete form block that has a pair of parallel foam panels that are spaced using plastic ties. U.S. Pat. No. 5,761,874 (Hayakawa) entitled "Concrete Form Spacing Fixture"discloses a separator that is used to assemble a concrete form structure.

SUMMARY

According to one aspect, there is provided a full wall height concrete form strapping and interconnect system, comprising a first panel having an outer surface and an inner surface and a second panel having an outer surface and an inner surface. There is more than one spacer having a first end and a second end. The first end of each spacer is positioned adjacent to the inner surface of the first panel and the second end of each spacer is positioned adjacent to the inner surface of the second panel such that the inner surface of the first panel and the inner surface of the second panel form a cavity for receiving a structural component. The second end of each spacer is connected to the second panel. The first end of each spacer has a first part of a two-part connector. At least one connector strap extends longitudinally along the outer surface of the first panel. The connector strap carries more than one second part of the two-part connectors. The second part of the two-part connector connects to the first part of the two part connector such that the connector strap attaches to the spacer.

According to another aspect, there is provided a structure resulting from the full wall height concrete form strapping and interconnect system described above used to form an enclosure.

According to another aspect, there is provided a structure comprising more than one building element. Each building element comprises a first panel having an outer surface and an inner surface, and a second panel having an outer surface and an inner surface. The first panel and the second panel are connected such that the inner surface of the first panel and the inner surface of the second panel form a cavity for receiving a structural component. The building elements are positioned to form an enclosure with each second panel positioned within the enclosure. At least one support strap encircles the building elements to maintain the enclosure.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
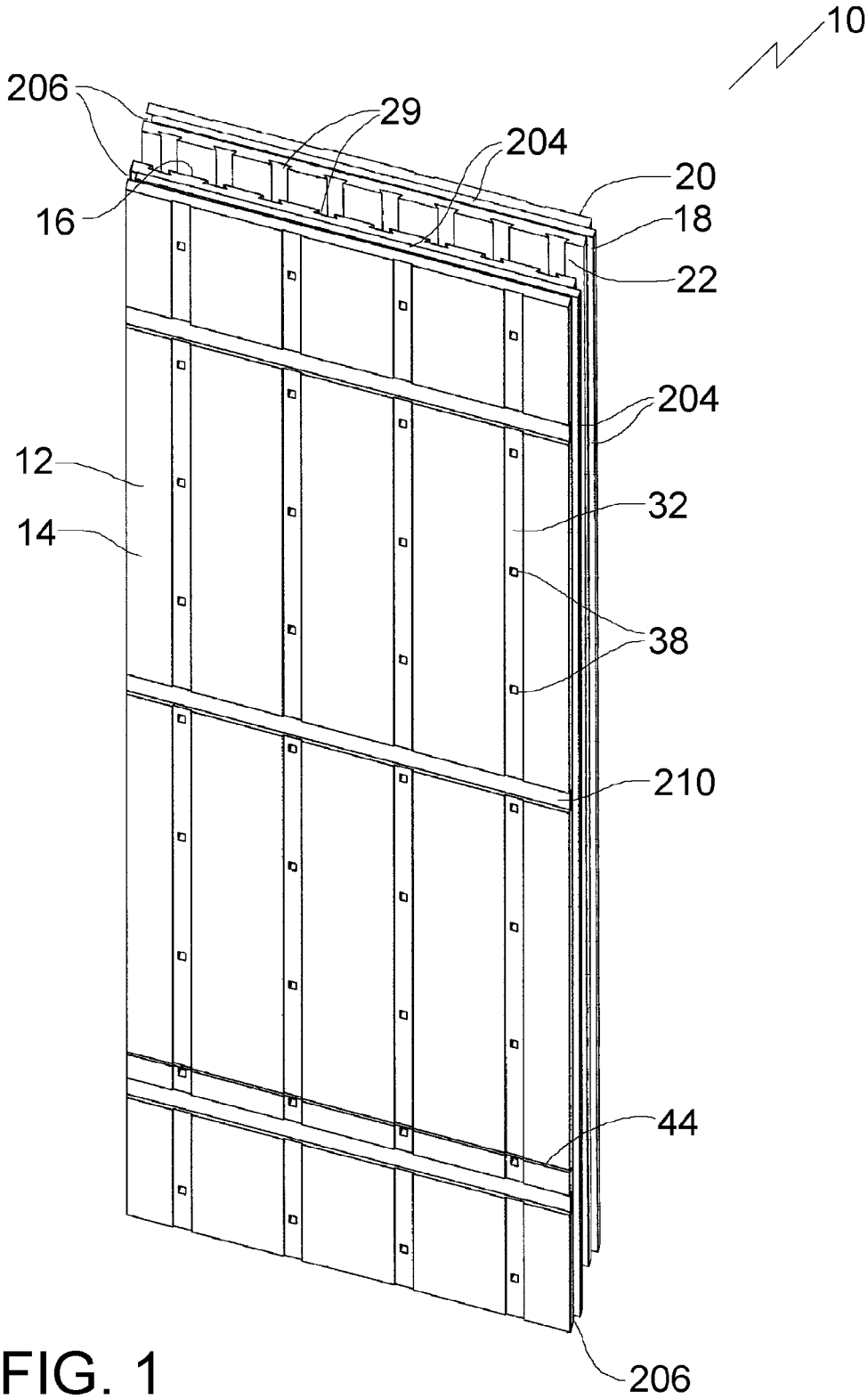
FIG. 1 is a perspective view of a planar building element.

Full wall height concrete form strapping and interconnect systems for forming a structure, will be described with reference to FIG. 1 through 7. Building elements include planar building elements and angled building elements, identified generally by reference numeral 10 and 100, respectively. A partially completed structure, identified generally by reference numeral 200, will be described with reference to FIG. 8.

Structure and Relationship of Parts of Building Elements 10 and 100:

In order to form a structure, it is necessary to have various elements. While building elements 10 and 100 as described herein are used to form the walls of structure 200 shown in FIG. 8, other elements that are known to those skilled in the art may also be necessary, and are not described herein. Those skilled in the art will understand how to incorporate these elements into a finished structure. Furthermore, elements 10 and 100 may be modified using known techniques to introduce other necessary elements, such as doors and windows. As such, these aspects will not be described in any further detail.

Figure 2:
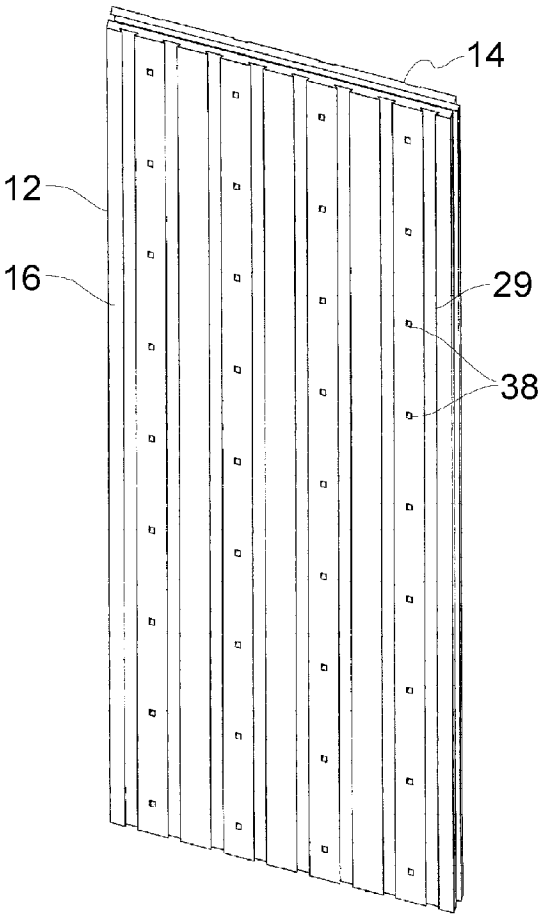
FIG. 2 is a perspective view of the inner surface of a first panel.
Figure 4:
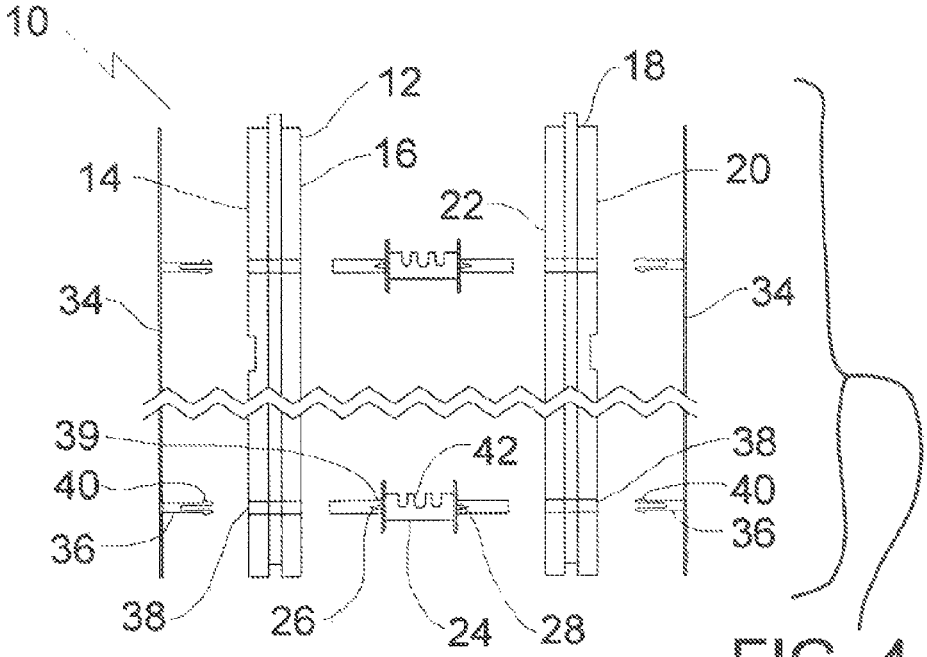
FIG. 4 is an exploded side view in section of a planar building element.
Figure 5:
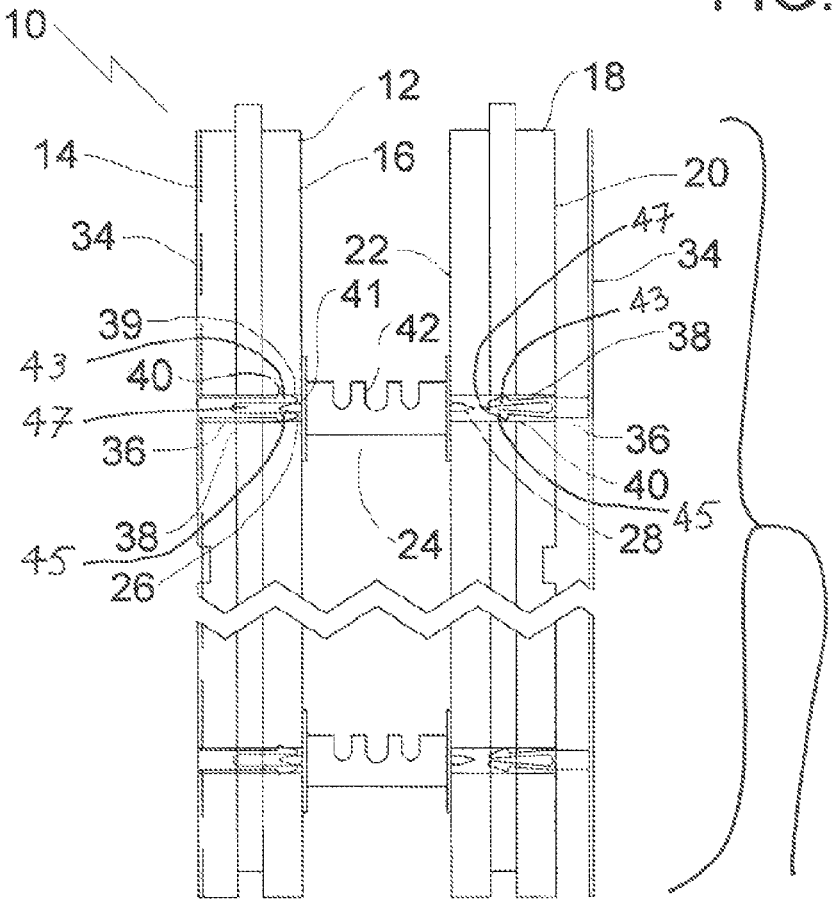
FIG. 5 is a side view in section of a planar building element.
Figure 6:
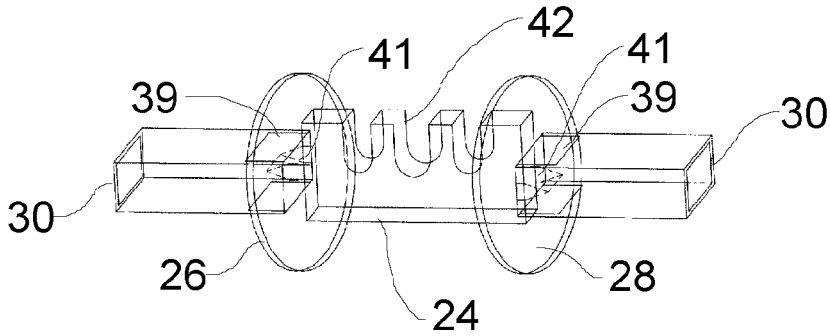
FIG. 6 is a perspective view of a spacer.
Figure 7:
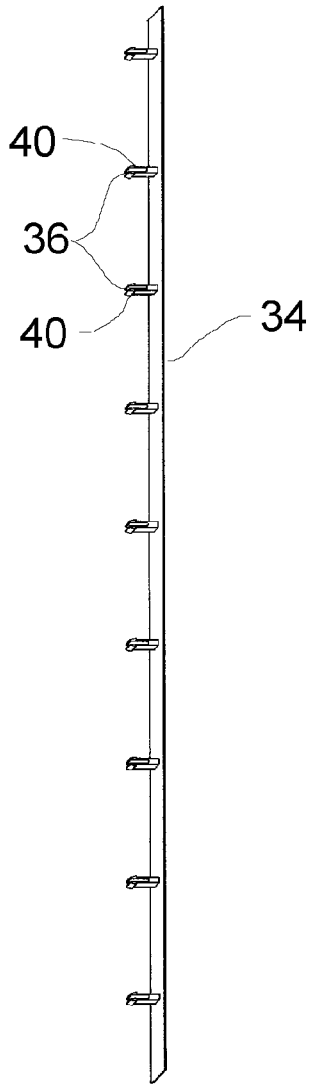
FIG. 7 is a side view of a connector strap.

Referring to FIG. 1, building element 10 includes a first panel 12 having an outer surface 14 and an inner surface 16, and a second panel 18 having an outer surface 20 and an inner surface 22. Panels 12 and 18 are preferably made from a lightweight material such as a polystyrene. The panel is cut to desired dimensions through a hot wire cutting process. This enables the panels to have a radius or bow, or to be cut in an angular configuration. Referring to FIG. 4, spacers 24 are positioned with a first end 26 adjacent to inner surface 16 of first panel 12, and a second end 28 adjacent to inner surface 22 of second panel 18 such that inner surface 16 of first panel 12 and inner surface 22 of second panel 18 form a cavity for receiving a structural component, such as insulated cement. A perspective view of spacer 24 is shown in FIG. 6. Referring to FIG. 2, inner surface 16 of first panel 12 (as well as inner surface 22 of second panel 18 as shown in FIG. 1) have dove tail chases 29 to secure cement and panel 12. As described above, dove tail chases 29 are preferably formed through a hot wire cutting process. Referring again to FIG. 6, each end 26 and 28 of spacers 24 has a first part 30 of a two-part connector. Referring to FIG. 1, the outer surfaces 14 and 20 of first and second panels 12 and 18 have connector grooves 32 for receiving connector straps 34 that extend longitudinally along first and second panels 12 and 18 (only shown on first panel 12). Connector grooves 32 should be deep enough such that connector straps 34 are flush with, or inset from, outer surfaces 14 and 20. Referring to FIG. 7, connector straps 34 carry the second part 36 of the two-part connectors to connect to first part 30 of the two part connector such that the connector strap 34 attaches to spacers 24. Referring to FIGS. 4 and 5, connector straps 34 are installed against both first panel 12 and second panel 18 by connecting first part 30 and second part 36 of the two part connectors through apertures 38 in panels 12 and 18. First end 26 and second end 28 of spacer 24 is widened to stop spacer 24 from entering aperture 38.

Referring to FIGS. 4 and 5, the two part connector may be a male to female press fit engagement. As shown, second part 36 of the two part connector is a male connector that can comprise opposing legs 43 and 45 defining opening 47 therebetween, the opposing legs 43 and 45 comprising an outer engagement profile 40 and first part 30 is a female connector. Referring to FIG. 6, female connector 30 has openings 39 and a wedge-shaped retainer 41. As shown in FIGS. 4 and 5, as male connector 36 is inserted into female connector 30, engagement profile 40 is forced inward until engagement profile 40 reaches openings 39, at which point engagement profile 40 returns to its original position. Engagement profile 40 engages openings 39, and retainer 41 becomes inserted into opening 47 and urges opposing legs 43 and 45 away from each other to help ensure male connector 36 cannot be removed under normal load conditions within the corresponding aperture 38.

Referring to FIG. 6, rebar supports 42 on spacers 24 may be provided such that rebar may be more easily installed to strengthen the cement when poured. In addition, referring to FIG. 1, outer surface 14 of first panel 12 (as well as second panel 18, not shown) may have cable-receiving channels 44 to run wiring such electrical wiring, television cable, network cables, telephone lines, and the like. The cable-receiving channels 44 are formed in the panels using the hot wire cutting process described above. The vertical and horizontal strapping serves to maintain the electric wiring in the cable-receiving channels. Although cable-receiving channels are shown in a particular orientation, it will be apparent that they can be cut horizontally, vertically, at an angle, or in any desired orientation.

Figure 3:
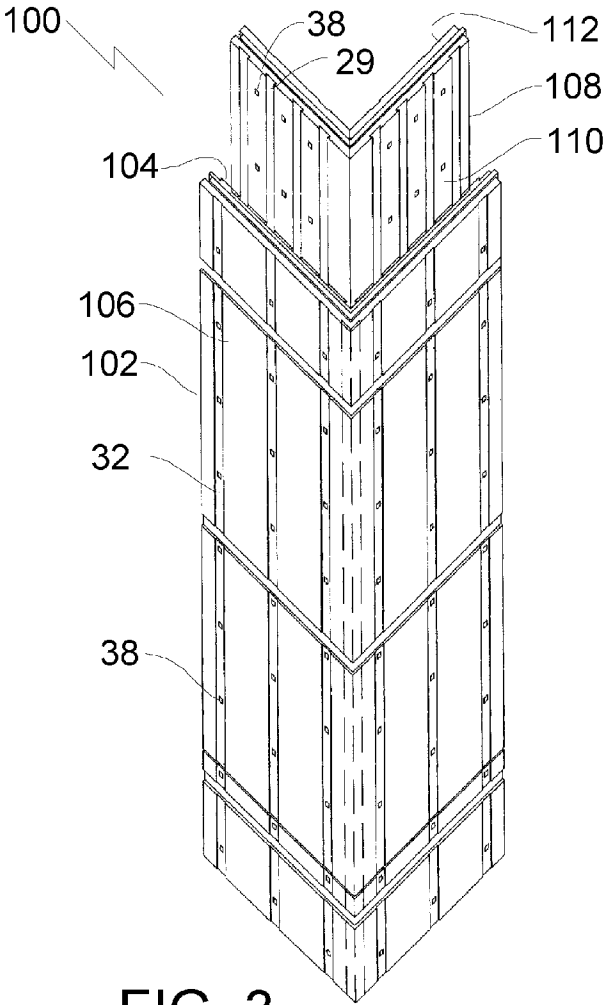
FIG. 3 is a perspective view of an angled building element.

Referring to FIG. 3, it can be seen that angled building element 100 has many similar features when compared with planar building element 10, except that angled building element 100 has an angled first panel 102 with an inner surface 104 and an outer surface 106, and an angled second panel 108 with an inner surface 110 and an outer surface 112. These panels 102 and 108 are assembled using elements similar to those described above, which have been given similar reference numerals. It will be understood that similar principles may be applied to building elements with a variety of shapes and angles. For example, angled building element 100 may set at a different angle instead of a 90 degree corner as shown. Alternatively, angled building element 100 may be rounded rather than having a corner, in which case the angle refers to the change in direction, rather than the angle of the corner.

Figure 8:
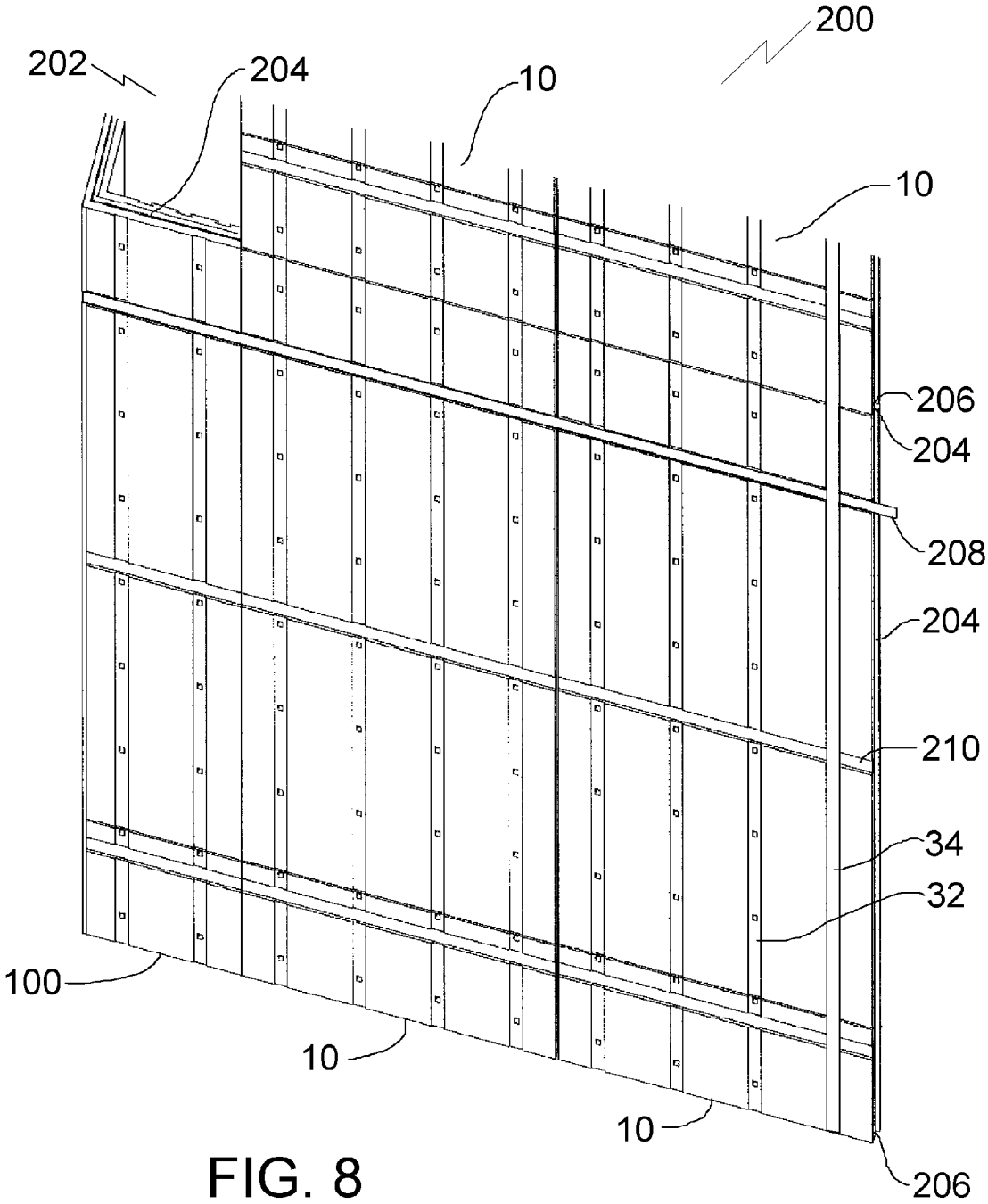
FIG. 8 is a perspective view of a partially completed structure.

Structure and Relationship of Parts of Partially Completed Structure 200:

Referring to FIG. 8, planar building elements 10 and angled building elements 100 may be positioned to form an enclosure 202, with each second panel 18 and second angled panel 108 positioned within enclosure 202. As shown, building elements 10 and 100 are connected to adjacent building elements using a tongue 204 and groove 206 design, although other connector designs may also be used. The edges of building elements 10 and 100 are formed such that the top edge and a side edge have a tongue 204, while the bottom edge and opposite side edge have a groove 206. Support straps 208 are used to encircle the building elements to support them, and to maintain enclosure 202. Support straps 208 are shown to underlie connector straps 34. Outer surfaces 16 and 106 of first panels 12 and 102 have support grooves 210 for receiving support straps 208 that are substantially perpendicular to connector grooves 32. As with connector grooves 32, support grooves are formed such that support straps 208 are inset from or flush with outer surfaces 16 and 106. It will be understood that grooves 32 and 210 need not run perpendicular. However, support straps 208 provide good support to a structure when they form a completed loop that is substantially horizontal, and connector straps 34 provide good support when substantially vertical.

Operation:

Referring to FIGS. 4 and 5, building element 10 is constructed by placing spacer between first panel 12 and second panel 18, and engaging first part 30 and second part 36 within each corresponding aperture 38, as shown. Angled building elements 100 shown in FIG. 3 are constructed in a similar fashion Referring to FIG. 8, once building elements 10 and 100 have been assembled, they are then placed to form enclosure 202 in the shape desired. Other shapes and sizes of building elements 10 and 100 may be used, as well as other components to create windows, doors, etc. Building elements 10 and 100 are connected using a tongue and groove connection to hold them in place until support straps 208 can be installed in support grooves 210. Once the overall structure has been formed, concrete (not shown) is then poured into the mould created by building elements 10 and 100. Concrete engages dove tail chases 29 to create a firm connection between elements 10 and 100, and the concrete.

Advantages:

The prior art was relatively complex to assemble and was vulnerable to wind damage during the interval of hours or days between assembly and the pouring of concrete. The building element described above is relatively simple to assemble and the vertical and horizontal strapping is capable of holding the structure together until concrete can be poured. The building element described can be pre-manufactured full wall height and width and shipped to the job site. This provides a dramatic advantage over interlocking block stacking systems. At the job site, the building element can rapidly be assembled with other building elements in preparation for filling with concrete. The panels have tongue and grooves that allow interlocking between building elements both horizontally and vertically. The spacers and connectors carried by the connector straps snap together and have slots which accept rebar reinforcement. The vertical strapping is held in place by the connectors. Horizontal strapping secures the panels together, with the vertical strapping assisting in maintaining the positioning of the horizontal strapping. Channels in the panels enable rapid installation of wiring, with the horizontal and vertical strapping assisting to hold the wiring in place. Internal dove tail slots in the panels guarantee engagement between the panels and the concrete. The panels are cut using a hot wire technique, which enable any desired angle of corner or radius to be made.

Figure 9:
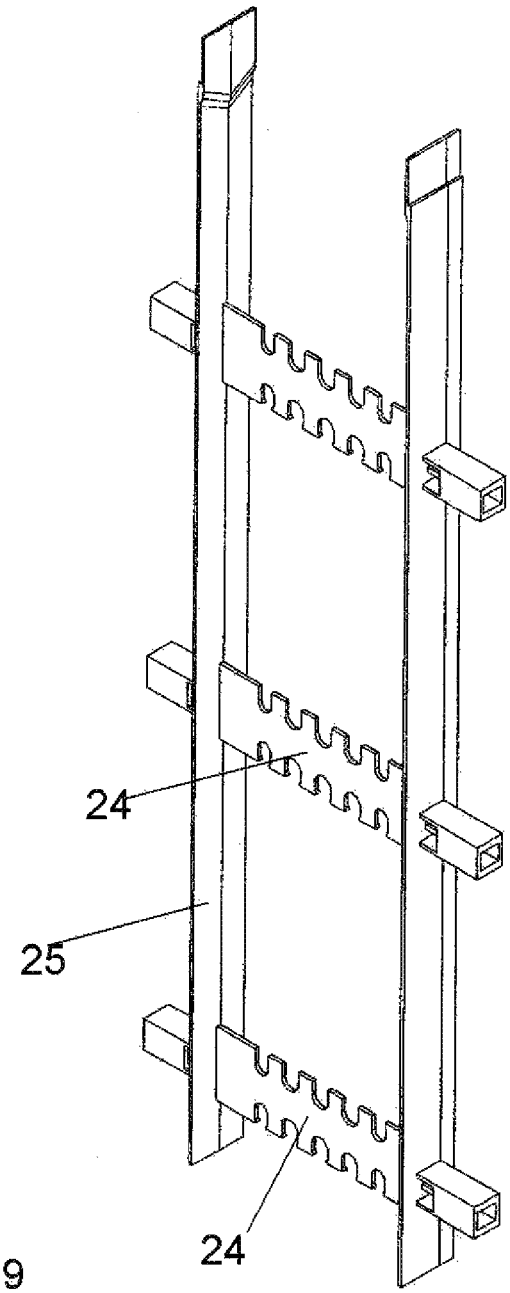
FIG. 9 is a perspective view of a frame that carries spacers.

Variations:

Referring to FIG. 9, after having some field experience with the system, it has been determined that there is an advantage to having spacers 24 tied together by a frame 25. When this was done some immediate benefits were obtained. One benefit was that the positioning, spacing and alignment of spacers 24 was simplified. Frame 25 ensures consistent positioning, without the need to individually position spacers 24. Another benefit was that the weight bearing capacity of each of the spacers 24 was increased, as there was a distribution of the load via frame 25.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope defined in the Claims.

What is claimed is:

1. A full wall height concrete form strapping and interconnect system, comprising:

a first panel having an outer surface and an inner surface;

a second panel having an outer surface and an inner surface;

more than one spacer having a first end and a second end, the first end of each spacer being positioned adjacent to the inner surface of the first panel and the second end of each spacer being positioned adjacent to the inner surface of the second panel such that the inner surface of the first panel and the inner surface of the second panel form a cavity for receiving a structural component, the second end of each spacer being connected to the second panel, the first end and the second end of each spacer having a first part of a two-part connector;

at least one connector strap extending longitudinally along each of the outer surfaces of the first panel and the second panel, each connector strap carrying more than one second part of the two-part connector, each second part of the two-part connector connecting to one of the first parts of the two-part connector such that each connector strap attaches to respective ones of the spacers; and wherein the second part of the two-part connector comprises a male connector having opposing legs, the opposing legs comprising an outer engagement profile and the first part of the of the two-part connector comprises a female connector, the female connector configured for receiving the male connector, the female connector further comprising a retainer configured to insert between the opposing legs and urge the opposing legs away from each other such that the outer engagement profile is forced outward into engagement with an opening disposed through the female connector when the male connector is inserted into the female connector to prevent the removal of the male connector from the female connector.

2. The full wall height concrete form strapping and interconnect system of claim 1, comprising more than one connector strap along each of the outer surfaces of the first panel and the second panel.

3. The full wall height concrete form strapping and interconnect system of claim 1, wherein the outer surface of the first panel comprises a groove for receiving the connector strap such that the connector strap is inset from or flush with the outer surface of the first panel.

4. The full wall height concrete form strapping and interconnect system of claim 1, wherein the outer surface of the first panel comprises a connector groove for receiving the connector strap and a support groove substantially perpendicular to the connector groove for receiving a support strap, such that the connector strap and the support strap are inset from or flush with the outer surface of the first panel.

5. The full wall height concrete form strapping and interconnect system of claim 4, wherein the support strap underlies the connector strap where the support strap and the connector strap intersect.

6. The full wall height concrete form strapping and interconnect system of claim 1, wherein the first panel comprises apertures for receiving the first and second parts of the two-part connectors.

7. The full wall height concrete form strapping and interconnect system of claim 1, wherein the spacers comprise rebar supports.

8. The full wall height concrete form strapping and interconnect system of claim 1, wherein at least one of the first panel and the second panel has cable-receiving channels.

9. The full wall height concrete form strapping and interconnect system of claim 1, wherein the structural component is concrete.

10. The full wall height concrete form strapping and interconnect system of claim 1, forming a planar building element.

11. The full wall height concrete form strapping and interconnect system of claim 1, forming an angled building element.

12. A structure comprising:

more than one building element, each building element comprising:

a first panel having an outer surface and an inner surface;

a second panel having an outer surface and an inner surface;

more than one spacer having a first end and a second end, the first end of each spacer being positioned adjacent to the inner surface of the first panel and the second end of each spacer being positioned adjacent to the inner surface of the second panel such that the inner surface of the first panel and the inner surface of the second panel form a cavity for receiving a structural component, the second end of each spacer being connected to the second panel, the first end and the second end of each spacer having a first part of a first two-part connector; and at least one connector strap extending longitudinally along each of the outer surfaces of the first panel and the second panel, each connector strap carrying more than one second part of the first two-part connector, each second part of the first two-part connector connecting to one of the first parts of the first two-part connector such that each connector strap attaches to respective ones of the spacers;

the building elements being positioned to form an enclosure with each second panel positioned within the enclosure; and wherein the second part of the first two-part connector comprises a male connector having opposing legs, the opposing legs comprising an outer engagement profile and the first part of the of the first two-part connector comprises a female connector, the female connector configured for receiving the male connector, the female connector further comprising a retainer configured to insert between the opposing legs and urge the opposing legs away from each other such that the outer engagement profile is forced outward into engagement with an opening disposed through the female connector when the male connector is inserted into the female connector to prevent the removal of the male connector from the female connector.

13. The structure of claim 12, comprising at least one support strap extending substantially perpendicular to the connector strap along the outer surface of the first panel.

14. The structure of claim 13, wherein the connector strap extends vertically and the support strap extends horizontally when the building elements are in upright positions.

15. The structure of claim 12, wherein each building element has a first part or a second part of a second two-part connector for connecting to an adjacent building element.

16. The structure of claim 15, wherein the second two-part connector is a male-female connector positioned along an edge of the building elements.

17. The structure of claim 15, further comprising angled building elements having the first part or the second part of the second two-part connector for connecting to adjacent building elements.

18. A structure comprising: more than one planar building element, each planar building element comprising:

a first panel having an outer surface and an inner surface;

a second panel having an outer surface and an inner surface;

a plurality of first spacers, each first spacer having a first end and a second end, the first end of each first spacer being positioned adjacent to the inner surface of the first panel and the second end of each first spacer being positioned adjacent to the inner surface of the second panel such that the inner surface of the first panel and the inner surface of the second panel form a cavity for receiving a structural component, the second end of each first spacer being connected to the second panel, the first end and the second end of each first spacer having a first part of a two-part connector;

at least one connector strap extending longitudinally along each of the outer surfaces of the first panel and the second panel, the outer surface of the first panel and the outer surface of the second panel comprising connector grooves for receiving the connector straps such that the connector straps are inset from or flush with the outer surfaces of the first and second panels, the connector straps carrying more than one second part of the two-part connectors, each second part of the two-part connector connects to one of the first parts of the two-part connector such that each connector strap attaches to respective ones of the spacer;

more than one angled building element, each angled building element comprising:

a first angled panel having an outer surface and an inner surface; and a second angled panel having an outer surface and an inner surface;

a second plurality of second spacers, each second spacer having a first end and a second end, the first end of each second spacer being positioned adjacent to the inner surface of the first angled panel and the second end of each second spacer being positioned adjacent to the inner surface of the second angled panel such that the inner surface of the first angled panel and the inner surface of the second angled panel form a cavity for receiving a structural component, the first end and the second end of each second spacer having the first part of the two-part connector;

at least one additional connector strap extending longitudinally along each of the outer surfaces of the first angled panel and the second angled panel, the outer surface of the first angled panel and the outer surface of the second angled panel comprising connector grooves for receiving the at least one additional connector strap such that the at least one additional connector strap is inset from or flush with the outer surfaces of the first and second panels, each at least one additional connector strap carrying more than one second part of the two-part connector, each second part of the two-part connector connecting to one of the first parts of the two-part connector such that each at least one additional connector strap attaches to respective ones of the spacers;

the planar building elements and the angled building elements being positioned to form an enclosure with each second panel and each second angled panel positioned within the enclosure; and at least one support strap encircling the planar and angled building elements to maintain the enclosure, the outer surface of the first panel and the outer surface of the first angled panel comprising at least one support groove substantially perpendicular to the connector grooves for receiving the support straps, such that the support straps are inset from or flush with the outer surface of the first panel and the outer surface of the first angled panel.

19. The structure of claim 18, wherein the second part of the two-part connector comprises a male connector having an outer engagement profile and the first part of the of the two-part connector comprises a female connector, the female connector configured for receiving the male connector such that the outer engagement profile is forced outward into engagement with an opening disposed through the female connector when the male connector is inserted into the female connector to prevent the removal of the male connector from the female connector.

20. The structure of claim 19, wherein the female connector further comprises a retainer configured to maintain the engagement of the engagement profile with the opening.

21. The structure of claim 18, wherein the connector straps extend vertically and the support strap extends horizontally when the planar and angled building elements are in upright positions.

22. The structure of claim 18, wherein each planar and angled building element has a first part or a second part of a second two-part connector for connecting to an adjacent one of the planar or angled building elements.

23. The structure of claim 22, wherein the second two-part connector is a male-female connector positioned along an edge of the planar and angled building elements.

* * * * *

UNITED STATES PATENT AND TRADEMARK OFFICE

CERTIFICATE OF CORRECTION

PATENT NO. : 8,616,520 B2
APPLICATION NO. : 12/200846
DATED : December 31, 2013
INVENTOR(S) : B. G. Baader It is certified that error appears in the above-identified patent and that said Letters Patent is hereby corrected as shown below:

In The Claims

| COLUMN | LINE | ERROR |
|---|---|---|
| 5 (Claim 1, | 29 line 27) | delete the second occurrence of "of the" |
| 7 (Claim 18, | 39 line 35) | "second plurality" should read --plurality-- |
| 8 (Claim 19, | 28 line 3) | delete the second occurrence of "of the" |

Signed and Sealed this
Ninth Day of June, 2015

Michelle K. Lee

Michelle K. Lee
*Director of the United States Patent and Trademark Office*